United States Patent [19]

Springer

[11] 4,003,616

[45] Jan. 18, 1977

[54] SWIVELLING ELECTRICAL CONNECTOR

[75] Inventor: William E. Springer, Stratford, Conn.

[73] Assignee: Clairol Incorporated, New York, N.Y.

[22] Filed: Dec. 3, 1975

[21] Appl. No.: 637,455

[52] U.S. Cl. ..... 339/8 R; 174/46; 339/101

[51] Int. Cl.[2] ..... H01R 39/00

[58] Field of Search ..... 339/8 R, 8 P, 58, 62, 339/101; 174/46

[56] References Cited

UNITED STATES PATENTS 3,950,052 4/1976 Walter et al. ..... 339/8 R

*Primary Examiner*—W. Tupman
*Assistant Examiner*—DeWalden W. Jones
*Attorney, Agent, or Firm*—Sherman & Shalloway

[57] ABSTRACT

A swivelling electrical connector includes a plug having an axially aligned contact and pair of tandemly spaced circumferential contacts. The plug registers with a socket structure disposed within the housing of an appliance which has complementary spring loaded contacts. One of the tandem contacts on the plug, preferably the one nearest the end of the housing, is a ground contact.

13 Claims, 4 Drawing Figures

SWIVELLING ELECTRICAL CONNECTOR

BACKGROUND OF THE INVENTION

1. Field of the Invention

The present invention relates to electrical connections or connectors. More particularly, the present invention is directed to a novel electrical connector for forming a novel electrical connection between an appliance and a power cord, wherein the appliance and cord can swivel relative to one another.

2. Technical Considerations and Prior Art

Many electrical appliances, such as for example hair curlers, hair dryers and hand-held power tools, are connected by flexible power cords to power sockets. In manipulating the appliances, there is a tendency for the cords to twist, and thereby place a strain on the connections between the appliances and cords.

In many appliances, especially appliances such as hair dryers and certain types of hair curlers, it is quite desirable to ground the appliances, in order to avoid the risk of shocking the users. Furthermore, it is necessary that electrical connectors used with these appliances be readily adaptable to modern hand-held appliances, which in order to be marketable, must be relatively inexpensive, light in weight, and generally uncomplicated. The prior art does not disclose or suggest connectors which provide structure for grounding the appliances, while at the same time meeting this criteria.

OBJECTS OF THE INVENTION

In view of the aforementioned deficiencies of the prior art, it is an object of the instant invention to provide a new and improved electrical connection.

An additional object of the instant invention is to provide a new and improved electrical connection between a power cord and appliance, wherein the connection includes grounding contact.

It is an additional object of the instant invention to provide a new and improved electrical connector, wherein the connector allows an appliance to swivel relative to an associated power cord.

It is still a further object of the instant invention to provide a new and improved electrical connector, wherein the connector provides connections for more than two conductors between a cord and appliance.

Still another object of the instant invention is to provide a new and improved electrical connection for establishing contact between sets of conductors, wherein each set includes more than two conductors.

It is an additional object of the instant invention to provide a new and improved electrical connector for forming an electrical connection between a cord and appliance, wherein the connection is safe.

Another object of the invention is to provide a new and improved swivel connector, which also acts as a strain relief for cord connections.

It is an additional object of the instant invention to provide a new and improved swivelling electrical connector for forming an electrical connection between a cord and appliance, which provides structure for connecting the appliance to ground.

SUMMARY OF THE INVENTION

In keeping with the aforementioned and other objects, the present invention contemplates an electrical connector for an appliance, where the connector couples the appliance to a power cord, having a plurality of conductors extending therein. The connector includes a plug and a socket, wherein both the plug and socket have cooperating shoulders, which serve to retain the plug within the socket. The plug includes an insulating body having at least three contacts thereon, one of which is axially aligned with the plug, and two of which are circumferentially disposed around the plug, while being axially spaced from one another. The insulating body has a cord engaging portion, which extends straight or at an angle to the plug and surrounds the cord to which it is bonded to form a strain relief, so that tension between cord and appliance is not transmitted through the conductors of the cord or appliance. The socket includes contacts, which slidably engage the contacts of the plug, so as to permit rotation between the plug and socket while electrical contact is maintained.

Other objects and advantages of the aforesummarized invention will become apparent from the following description of a preferred embodiment, taken in conjunction with the attached drawings.

DESCRIPTION OF THE PREFERRED EMBODIMENT

Figure 1:
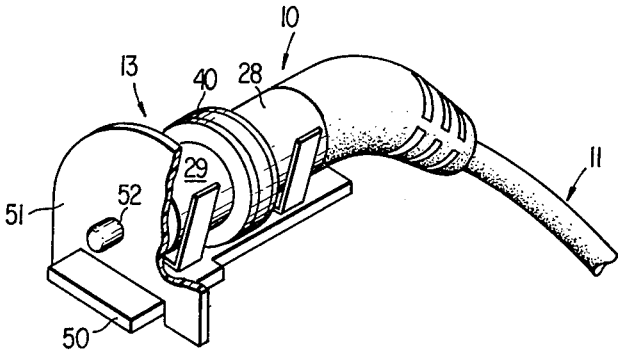
FIG. 1 is a perspective view of a connector in accordance with the instant invention, showing a plug engaging portion of a socket structure.
Figure 2:
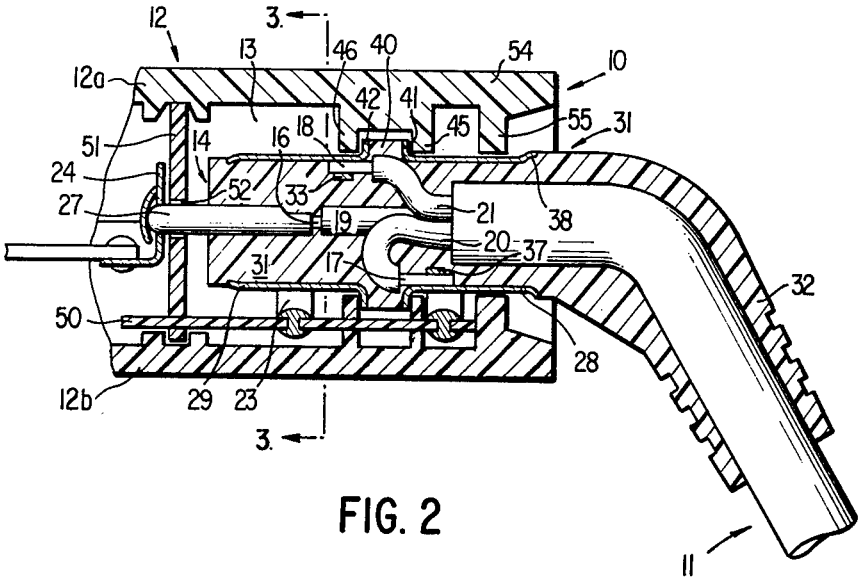
FIG. 2 is a side view partially in cross-section, showing the plug and socket structure combined with one end of a housing of an appliance.

Referring now to FIGS. 1 and 2, there is shown an electrical connector, generally designated by the numeral 10, for connecting an appliance (not shown) to a power cord, generally designated by the numeral 11. The appliance includes a housing, generally designated by the numeral 12, one end of which is shown, and in which a socket structure, generally designated by the numeral 13, is disposed. A plug, generally designated by the numeral 14, is retained within the housing 12 by the structure of the socket 13.

The mechanical connection, between the plug 14 and socket 13, is configured so that the plug may rotate relative to the socket, while the socket remains axially fixed relative to the housing. By so configuring the connection, torsional stresses between the cord and appliance are eliminated.

As seen specifically in FIG. 2, the cord 11 has three conductors 16, 17 and 18 extending therein. The conductors 16, 17 and 18 are surrounded by insulation sheaths 19, 20 and 21, respectively, which are put on the conductors prior to assembling the conductors into the cord 11. The purpose of the connector 10 is to establish a sliding electrical connection between the conductors 16, 17 and 18 and contacts 22, 23 and 24 in the housing 12 which may be, in turn, connected to an appliance.

As seen in FIG. 2, the plug 14 accomplishes this connection between the conductors 16, 17 and 18 and the contacts 22, 23 and 24, by contacts 27, 28 and 29, respectively. The contacts 27, 28 and 29 are mounted on and retained by an insulating body, generally designated by the numeral 31, which defines the geometry of the plug 14 and also has a cord engaging portion 32, which surrounds the cord 11. The portion 32, preferably, is disposed at an angle to the rest of the insulating body 31, so that the cord 11 will generally extend downwardly from the appliance and the housing 12, without twisting as the appliance is utilized.

Preferably, the cord engaging portion 32 is molded from polyvinyl chloride or another resilient plastic or rubber material, and is molded around and bonded to the power cord 11 to provide a mechanical interlock between the plug 14 and cord.

Figure 3:
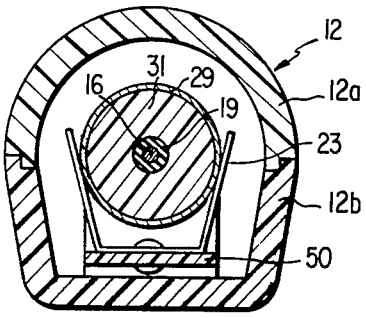
FIG. 3 is a section taken through lines 3—3 of FIG. 2, showing the plug, housing and a socket contact generally in cross-section.

The insulating body 31 surrounds and supports both the conductors 16, 17 and 18 and the insulating sheaths 19, 20 and 21, which surrounds the conductors. As seen in FIG. 3, the insulating body 31 is circular in cross-section, so that it may accommodate the rotation, which is necessary to allow the housing 12 and appliance to swivel relative to the cord 11. The contact 27 is axially aligned with the circular portion of the insulating body 31, and receives the conductor 16 therein. Preferably, the contact 27 is a hollow pin type contact, in which the conductor 16 is inserted and crimped or soldered.

Figure 4:
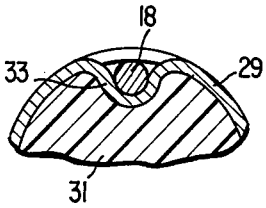
FIG. 4 is an enlarged cross-section of the plug, showing how conductors from the cord to which the plug is attached are secured to contacts on the plug.

According to a preferred embodiment, the contact 29 is disposed circumferentially around the insulating body 31 and receives the conductor 18 in a lanced depression 33, as seen in FIG. 4. The lanced depression 33 is formed by making a pair of parallel cuts in the contact 29, and depressing the portion defined by the cuts to provide an opening. Solder is then flowed into the opening to secure the conductor between the depression 33 and the inner surface of the contact 29.

The contact 28 is also circumferentially disposed around the insulating body 31, but is axially spaced from the contact 29, so that the contacts 28 and 29 are arranged in tandem on the insulating body. Contact 28 has a lanced depression 37, which is similar to the lanced depression 33 of contact 29, shown in FIG. 4. The lanced depression 37 receives the conductor 17, which is bent to approximately 180° and inserted between the lanced depression 37 and the inner surface of contact 28. Solder is flowed over the connection between the conductor 17 and lanced depression 37 and contact 28, in order to secure the connection.

Alternatively, the conductors 17 and 18 may be secured to their respective contacts 28 and 29 by approaches other than the afore-described preferred embodiments. For example, the lanced depressions 33 and 37 may be flattened against, or deformed against, the conductors 18 and 17 in order to secure contact between the depressions and conductors. In another approach, the depressions 33 and 37 can be omitted completely, and the conductors 17 and 18 secured by soldering or welding directly to the contacts 28 and 29.

The insulating body 31 has a circular shoulder 40, which projects therefrom and which is abutted by circular flanges 41 and 42 on the contacts 28 and 29, respectively. As will be explained hereinafter, the flanges 41 and 42 supported by the shoulder 40 form what is essentially a thrust bearing, which holds the plug 14 within the socket structure 13 of the housing 12, while allowing the plug to rotate within the socket structure.

In the preferred embodiment, the insulating body is made of an elastic material, such as molded polyvinyl chloride, which is molded around and bonded to the outer jacket of the cord. A flared upset 38 is used to provide a smooth transition to the enlarged section of body 31, which is required for added stiffness.

Further, with respect to the construction of contact 27, the contact 27 may be of a pin construction. However, in the alternative, the contact 27 could be a button or a hollow member with the associated socket contact being configured to make an appropriate connection.

The socket structure 13 is configured to rotatably receive the plug 14, and to hold the plug in place so that the plug cannot be axially slid from the housing 12. As seen in FIG. 2, the socket structure 13 includes circular flanges 45 and 46, which define a pair of annular shoulders between which the circular flanges 41 and 42 of the contacts 28 and 29 are seated. The flange 46 engages the flange 42 to prevent the plug 14 from moving too far into the housing 12, while the flange 45 engages the flange 41 to prevent the plug from being removed from the housing. Since the shoulders are all circular, the plug 14 may rotate while being retained within the housing 13. The projecting portion 40 of insulating body 31 provides a resiliency which absorbs shock, when the cord 11 is either abruptly pulled relative to the housing 12 or when the plug 14 is pushed abruptly into the housing 12.

In the preferred embodiment, in order to facilitate assembly of the plug 14 into the socket structure 13, the housing 12 consists of two mating halves **12*a* and 12*b* which are assembled around the plug 14 and which are held together with screw fasteners, not shown, located outside of the socket 13** area.

The socket contacts 22 and 23 are preferably U-shaped as shown in FIG. 3, and are preferably of a spring material, so as to remain urged against the circular contacts 28 and 29 of the plug 14. According to the preferred embodiment, the socket contacts 22 and 23 are riveted or otherwise secured to a printed circuit board 50, which has circuit paths thereon leading to appropriate terminals in the associated appliance (not shown).

While the socket contacts 22 and 23 are preferably configured and arranged as shown, other approaches may be used. For example, carbon brush contacts could be employed, which are biased by leaf or coil springs into engagement with the contacts 28 and 29 of the plug 14.

Straddling one end of the circuit board 50 is a flange 51 of insulating material, which has a bore 52 therethrough which passes the pin 27. The socket contact 24 is positioned on the opposite side of the flange 51, so as to be engaged by the pin 27 after the pin 27 is passed through the bore 52. The flange 51 serves as both an insulating shield and as a support for the pin 27, which engages the inner periphery of the bore 52. In addition, the flange 51 may also support the contact 24.

As seen in FIG. 2, the housing 12 has an extended portion 54 which extends past the contact 28, and has an annular flange 55 projecting inwardly therefrom to further support a seal the electrical connection 10.

According to the preferred embodiment of the present invention, the conductor 16, connected to the axially disposed pin 27, is the ungrounded supply lead which is hot, while the conductor 18, secured to contact 29, is the ground supply return. Conductor 17 is the ground and is secured to contact 28. This is an important consideration, if it is desired to have a compact connector in a short housing. Accidental contact by the user with the ground contact 28 causes no safety problems, because the ground contact 28 has the same potential as any exposed metal part of the appliance. If, however, for some reason, the size of the connector is not an important design feature and there is sufficient room to insulate the contact 28, then the position of the various contacts is not as important, so long as each conductor is connected to the correct terminal of the supply plug at the other end of the cord 11. However, it should be kept in mind that location of the power leads or power conductors 16 and 17, well within the housing 12, decreases the possibility of the user being shocked.

From the afore-described embodiment, it is seen that an electrical connection, in accordance with the instant invention, provides a structurally simple connection which is highly reliable, safe and economical to produce.

Inasmuch as the instant invention is subject to many variations, modifications and changes in detail, it is intended that all matters described above or shown in the accompanying drawings be interpreted as illustrative and not as limiting. The scope of the instant invention is to be limited only by the following appended claims:

What is claimed is:

1. An electrical connector for an appliance having a housing wherein the connector couples the appliance to a power cord having three conductors therein, said connector comprising:

a. a plug, said plug comprising:

an insulating body having a plug contact-supporting portion and a cord-engaging portion, wherein said plug contact-supporting portion is cylindrical in cross-section, and said cord-engaging portion has a section extending plug contact-supporting portion;

a first plug contact supported by said plug contact-supporting portion and axially aligned therewith, wherein said first contact is connected to a first conductor of the power cord;

a second plug contact circumferentially supported by said plug contact-supporting portion and connected to a second conductor of said power cord;

a third plug contact circumferentially supported on said plug contact-supporting portion and axially spaced from said second contact in the direction of said power cord, wherein a third conductor of said power cord is connected thereto, and shoulder means formed on said plug for retaining said plug in said housing:

b. a socket formed in one end of said housing for rotatably receiving said plug, said socket comprising socket contacts slidably engaging said plug contacts to allow rotation of said plug relative to said socket and said housing, while maintaining electrical connections therebetween, and annular shoulder means within said socket and registering with said shoulder means on said plug for retaining said plug within said socket and said housing.

2. The connector of claim 1 wherein the socket contacts are leaf spring members urged in engagement with the plug contacts by inherent resiliency.

3. The connector of claim 2 wherein the socket contacts engaging the second and third plug contacts are U-shaped leaf springs retained in tandem on a printed circuit board disposed within said socket adjacent said plug, and wherein said first plug contact is a pin extending beyond said insulation body into abutting relation with the associated socket contact.

4. The electrical connector of claim 1 wherein the connections between said second and third plug contacts and said conductors are formed by seating the conductors within lanced depressions formed in the contacts.

5. The electrical connector of claim 1 wherein the first plug contact is a hollow pin, which is crimped to the first conductor.

6. The electrical connector of claim 1 wherein the first conductor is a power conductor, the second conductor is a ground supply conductor, and the third conductor is a ground conductor.

7. The electrical connector of claim 3 wherein the socket includes a bulkhead having a bore therethrough to receive the first conductor so as to support the plug, and wherein the associated socket conductor is disposed on the opposite side of said bulkhead from said plug.

8. The electrical connector of claim 1 wherein the conductors of said power cord each have a layer of insulation therearound, which is surrounded by the insulating body.

9. The electrical connector of claim 1 wherein the annular shoulder means of said socket projects inwardly therefrom and includes an annular indentation defining a pair of annular spaced walls, and wherein the shoulder means of said plug projects radially therefrom and registers between said walls.

10. The electrical connector of claim 9 wherein the shoulder means of said plug is defined by flange portions on said second and third plug contacts which have a projecting section of said insulating body therebetween.

11. An electrical connector according to claim 1 wherein the insulating body is molded from a resilient material which is molded around and bonded to said power cord.

12. The electrical connector of claim 11 wherein the resilient material is polyvinyl chloride.

13. An electrical connector according to claim 1 wherein said section extending the plug contact-supporting portion extends at an angle to the plug contact-supporting portion.

* * * * *